US005254181A

United States Patent [19]

Yoshino et al.

[11] Patent Number: 5,254,181

[45] Date of Patent: * Oct. 19, 1993

[54] METHOD OF NITRIDING STEEL UTILIZING FLUORIDING

[75] Inventors: Akira Yoshino, Osakasayama; Masaki Tahara, Takatuski; Haruo Senbokuya, Tondabayashi; Kenzo Kitano, Kawachinagano; Teruo Minato, Hashimoto, all of Japan

[73] Assignee: Daidousanso Co., Ltd., Osaka, Japan

[ * ] Notice: The portion of the term of this patent subsequent to May 19, 2009 has been disclaimed.

[21] Appl. No.: 727,614

[22] Filed: Jul. 10, 1991

Related U.S. Application Data

[63] Continuation-in-part of Ser. No. 688,217, Apr. 22, 1991, abandoned, Continuation-in-part of Ser. No. 479,013, Feb. 12, 1990, Pat. No. 5,013,371.

[30] Foreign Application Priority Data

Jun. 10, 1989 [JP] Japan ..... 1-177660

[51] Int. Cl.[5] ..... C23C 8/34

[52] U.S. Cl. ..... 148/231; 148/232; 148/318

[58] Field of Search ..... 148/230, 231, 232, 209, 148/222

[56] References Cited

U.S. PATENT DOCUMENTS

| | | | |
|---|---|---|---|
| 2,851,387 | 9/1958 | Low | 148/220 |
| 4,975,147 | 12/1990 | Tahara, I et al. | 156/646 |
| 5,013,371 | 5/1991 | Tahara, II et al. | 148/16.6 |
| 5,114,500 | 5/1992 | Tahara, II et al. | 148/220 |

FOREIGN PATENT DOCUMENTS

| | | | |
|---|---|---|---|
| 0352061 | 1/1990 | European Pat. Off. . | |
| 0408168 | 1/1991 | European Pat. Off. . | |
| 55-014850 | 2/1980 | Japan | 148/230 |
| 56-130467 | 10/1981 | Japan | 148/230 |
| 638635 | 12/1978 | U.S.S.R. . | |

*Primary Examiner*—Melvyn J. Andrews
*Assistant Examiner*—Margery S. Phipps
*Attorney, Agent, or Firm*—Armstrong, Westerman, Hattori, McLeland & Naughton

[57] ABSTRACT

This invention relates to a method for forming a uniform, deep nitride layer on and in steel works at low cost, wherein a steel work is fluorided in heated condition in an atmosphere of a mixed gas composed of fluorine gas and inert gas and, then, nitrided in heated condition in an atmosphere of nitriding gas.

2 Claims, 2 Drawing Sheets

METHOD OF NITRIDING STEEL UTILIZING FLUORIDING

This application is a continuation-in-part of application Ser. No. 688,217 filed Apr. 22, 1991, now abandoned, which in turn was a continuation-in-part of Ser. No. 479,013 filed Feb. 12, 1990, now U.S. Pat. No. 5,013,371.

BACKGROUND OF THE INVENTION

1. Field of the Invention

The present invention relates to a method of nitriding steel for nitrogen case-hardening of steel which comprises subjecting a steel work to a special pretreatment that is conductive to a deep and uniform nitride layer or case.

2. Brief Description of the Prior Art

For the purpose of improving the wear resistance, corrosion resistance and mechanical properties such as fatigue strength etc. of steel, it is common practice to form a nitride layer or case on the surface of steel. Typical of this technique is the nitriding (gas nitriding, gas soft nitriding) process employing ammonia gas alone or a mixed gas composed of ammonia and a carbon source-containing gas (RX gas). Methods of this kind have problems with process stability in that when an alloy steel work or a steel work with an intricate configuration is treated, the resulting nitride case tends to be uneven.

While steel works are generally nitrided at temperatures not below 500° C., the adsorption and diffusion of nitrogen on and into the surface layer of steel requires not only the absence of organic and inorganic stains but also the absence of an oxide film. Furthermore, the steel surface itself must be high in activity, too. Actually, however, it is impossible to prevent formation of an oxide film or obtain complete activation of the steel surface in such nitriding processes. Taking an austenitic stainless steel work as an example, it is generally cleaned with hydrofluoric acid-nitric acid to remove the passivation film from the surface prior to charge into the nitriding furnace but it is difficult to completely remove the passivation film and impossible to completely activate the surface layer of the steel. Therefore, it is near to impossibility to form a satisfactory nitride case. Moreover, the removal of organic and inorganic stains prior to nitriding is generally carried out by alkali degreasing or organic cleaning with, for example, trichloroethylene but the recent antipollution regulations (control against destruction of the ozonosphere) frustrate the practice of organic cleaning which is the most effective cleaning method so far available and this factor is also a major obstacle to the formation of a satisfactory nitride case.

Under the circumstances, the inventors of the present invention previously found that when a steel work prior to nitriding is first fluorided in heated condition under a fluorine-containing gas blanket such as $NF_3$ and, then, nitrided, both the cleaning (removal of organic and inorganic stains and removal of the oxide film) and activation of the steel surface can be accomplished to give a satisfactory nitrogen case and a patent on the technology is pending (Japanese Patent Application No. 1-177660 and U.S. Ser. No. 479,013 filed on Feb. 12, 1990, now U.S. Pat. No. 5,013,371). In this method, the steel work is first heated and contacted with a gas, such as $NF_3$, in a furnace for pretreatment. As a result, the organic and inorganic stain components adhering to the steel surface are destroyed by the activated fluorine atoms to leave a clean steel surface and, at the same time, the passivation film, inclusive of the oxide film, on the steel surface is converted to a fluoride film to cover and protect the steel surface. The steel work is then nitrided. In this nitriding process, the above fluoride film is destroyed and removed by introducing a mixed gas composed of a nitrogen source-containing nitriding gas (e.g. $NH_3$ gas) and $H_2$ gas into the furnace under heating. More specifically, the destruction and removal of said fluoride film leaves a clean and activated steel surface and the N atoms in the nitriding gas rapidly penerate and diffuse into this cleaned, activated steel to form a uniform and deep nitride case. However, despite the above-mentioned desirable performance characteristic of $NF_3$ gas, it has the disadvantage of high cost. Moreover, a fairly high temperature (280°-500° C.) is required for adequate fluoriding and this means a significant thermal energy consumption, thus adding to the cost of treatment.

OBJECTS OF THE INVENTION

Having been developed under the above circumstances, the present invention has as its object to provide a method of nitriding steel which is capable of forming a uniform and deep nitride case at low cost.

DISCLOSURE OF THE INVENTION

To accomplish the above-mentioned object, the present invention is directed, in a first aspect, to a method of nitriding steel characterized by fluoriding a steel work in heated condition under a blanket of a fluorine gas-inert gas mixture and, then, nitriding the same work in heated condition under a blanket of nitriding gas and, in a second aspect, to a method of nitriding steel characterized by fluoriding a steel work in heated condition under a blanket of a fluorine gas-nitrogen trifluoride gas-inert gas mixture and, then, nitriding the same work in heated condition under a blanket of nitriding gas.

The inventors of the present invention performed a series of investigations for the cost reduction of a nitriding process using $NF_3$ as a fluoriding gas and found that fluorine gas ($F_2$) which was not formerly considered to be suited for fluoriding at the stage of development of the above-mentioned basic invention employing $NF_3$ as the fluoriding gas actually has excellent fluoriding activity and that fluorine gas achieves fluoriding at a considerably lower temperature than $NF_3$. The present invention is based on the above finding.

That is, the first invention in this application is directed to a fluoriding process employing a mixture of $F_2$ and an inert gas such as $N_2$. By this technique, substantial fluoriding can be accomplished at a comparatively low temperature in the range of about 150° C. to about 300° C., preferably about 200° C. to about 250° C. The second invention is concerned with a fluoriding process employing a mixed gas composed of $N_2$, $F_2$ and $NF_3$. In this latter process, fluoriding can be accomplished at a temperature in the range of about 200° C. to about 400° C., preferably about 250° C. to about 300° C., which is lower than the temperature required for the prior process using $NF_3$ as the fluoriding gas, although this temperature is slightly higher than that required for the first-mentioned process employing a mixed gas composed of $N_2$ and $F_2$, as the fluoriding gas. It was, thus, found that there is a temperature difference of as much as 100° C. to 150° C. between the fluoriding temperature in the case of using $F_2$ alone ($F_2+N_2$) and the fluoriding temperature in the case of using $NF_3$ alone ($NF_3+N_2$). It should be understood that, in the present invention, fluoriding can be performed at a temperature beyond the above-mentioned range, for example about 500° C. at the maximum, if desired. As the $F_2$ gas (fluorine gas), not only a general $F_2$ gas which is formed by a melting electrolytic method and the like, but also $F_2$ gas which is formed by thermal-cracking by introducing a F-containing composed such as $BF_3$, $CF_4$, HF, $SF_6$, $C_2F_6$, $WF_6$, $CHF_3$, $SiF_4$ into a thermal-cracking apparatus may be used. $F_2$ used in this invention includes such $F_2$ formed by thermal-cracking.

The present invention is now described in further detail.

In accordance with the present invention, either (1) a mixed gas of $N_2+F_2$ or (2) a mixed gas of $N_2+F_2+NF_3$ is employed for fluoriding as mentioned above.

In the case of using (1) a binary mixture of $N_2+F_2$, the concentration of $F_2$ is set at 0.05 to 20% (by volume; the same applies hereinafter). The drawback of $F_2$ is that since it is highly reactive, control of fluoriding is difficult at a high concentration. Thus, though $F_2$ is rather easy to control at a concentration net exceeding 1%, prolonged trearment is required for sufficient case hardening of steel. Therefore, the preferred $F_2$ concentration is 3 to 10%. In the case of using (2) a mixed gas of $F_2+NF_3+N_2$, the preferred concentration of $F_2$ is 1 to 5% and that of $NF_3$ is 1 to 20%. In the case of using the ternary mixture of $F_2+NF_3+N_2$, the proportions of $F_2$ and $NF_3$ depend on the scheduled fluoriding time and temperature. Thus, since a longer fluoriding time means a longer working time, the ratio of $F_2$ to $NF_3$ in the ternary gaseous mixture is determined in consideration of this disadvantage and the cost of the fluoriding gas.

The substrate steel for the present invention includes a variety of steels such as carbon steel, stainless steel and so on. These steels are not limited in shape or the like and may be in the form of plate or coil or even in the processed shape of a screw or the like. The substrate steel for the present invention is not limited to said steels, either, but includes alloys of said steels and alloys based on said steels and supplemented with other metals.

In accordance with the present invention, the substrate steel is either treated using (A) a first heat treating furnace for fluoriding and a second treating furnace for nitriding or (B) in a single heat treating apparatus having both a fluoriding chamber and a nitriding chamber.

In the case of treating the substrate steel using (A) a heat treating furnace for fluoriding and a heat treating furnace for nitriding, the process may for example comprise the following steps. First, fluoriding is performed in said heat treating furnace for fluoriding in the following manner. Thus, the steel work to be case-hardened is placed in the first heat treating furnace for fluoriding and heated to a temperature of 150°-300° C., preferably 200°-250° C. Then, in the same condition, fluorine gas ($F_2+N_2$) is introduced into the heating furnace and the steel work is maintained at the same temperature as above in an atmosphere of said fluorine gas for about 10 to 120 minutes, preferably for about 20 to 90 minutes, and for still better results for about 30 to 60 minutes. In the case of using $F_2$ formed by cracking a compound such as $BF_3$, a cracking apparatus is disposed in front of the heat furnace or in the vicinity of the heat furnace. After thermal-cracking the abovementioned compound, formed $F_2$ is mixed with $N_2$ and the mixture is introduced into the heat furnace. By this procedure, the passivation film (mainly composed of oxide) on the steel surface is converted to a fluoride film. This reaction proceeds for example in accordance with the following reaction formulas.

$$FeO+F_2 \rightarrow FeF_2+1/2O_2$$

$$Cr_2O_3+2F_2 \rightarrow 2CrF_2+3/2O_2$$

The above treatments are each carried out using a heat treating furnace such as, for example, the one illustrated in FIG. 1.

Referring to the accompanying drawings, the reference numeral 1 indicates a bell-shaped outer cover and 2 indicates a cylindrical inner cover which is covered with said outer cover. Integrally disposed on top of said outer cover I is a frame structure 10 having an engaging means 10*a* for engaging the hook of a crane or the like. Integrally disposed on top of said inner cover 2 is a cover structure 11 having an engaging means 11*a* for engaging the hook of a crane or the like. Formed within said inner cover 2 is a fluoriding chamber and the space between the two covers 1 and 2 constitutes a heating chamber. The reference numeral 3 indicates steel works which are charged into and taken out from said inner cover 2. The steel works 3 are mounted on a platform 15 having a center hole 14 and staged up in the space between a first cylindrical wire-mesh member 16 extending upwards from said center hole 14 and a second cylindrical wire-mesh member 17*a* extending upwards from the periphery of said platform 15 through interposed porous dividers 17*b* each having a center hole. The reference numeral 4 indicates a port for installation of a burner as formed in the peripheral wall in the lower part of said outer cover 1, and 4*a* indicates an exhaust port formed in the top wall of the outer cover 1. The reference numeral 5 indicates a base and 6 indicates a fan for circulation of the furnace atmosphere. This fan 6 faces the center hole 14 of the platform 15 and circulates the furnace atmosphere via the center hole 14 and the cylindrical wire-mesh member 16 extending upwards therefrom. The reference numeral 7 indicates a heat exchanger which is disposed in a pipe 7*a* extending downwardly from the base of said inner cover 2. The reference numeral 8 indicates a circulation blower for forced cooling which is installed in the pipe 7*a* downstream of said heat exchanger 7, while a pipe for introducing fluorine gas into the inner cover 2 is indicated at 9. Indicated at 12*a* is an exhaust gas pipe for withdrawal of spent gas, from the inner cover 2, which is bifurcated in an intermediate position, with one of branch pipes 17 being equipped with a valve 18 and the other branch pipe 19 being equipped with a valve 20 and a vacuum pump 21. When the spent gas pressure in the inner cover 2 is high, the route of branch pipe 17 is used, while the route of branch pipe 19 is used for vacuum evacuation by the suction force of the vacuum pump 21 when the spent gas pressure is low. The reference numeral 12 indicates an antipollution device which is connected to the terminal end of said exhaust gas pipe 12*a*. This antipollution device 12 comprises a transverse pair of activated carbon columns 22, a heater coil 23 wound round the periphery of each column, and a fin-type heat exchanger 24 and functions in such a manner that the spent gas introduced into the activated carbon column 22 is converted to harmless $CF_4$ by thermal reaction of residual $F_2$ etc. with the activated carbon and fed to the fin-type heat exchanger 24 for cooling. Indicated at 13 is a scrubber disposed in a pipe 25 extending from said heat exchanger 24. This scrubber 13 contains water and functions to thoroughly treat the spent gas harmless for release into the atmosphere by reducing the spent gas from the pipe 25 into bubbles so as to dissolve the HF fraction (which is by-produced by reaction of $F_2$ with $H_2O$ and $H_2$ in inner cover 2) of the spent gas in the water.

Using this heat treating furnace, fluoriding is performed as follows. Thus, the hook of a crane or the like (not shown) is engaged with the engaging means 10*a* and 11*a* of said outer cover I and inner cover 2 to suspend the outer cover 1 and inner cover 2 with the crane or the like. In this condition, the substrate steel 3 is set up on the platform 15 as illustrated and the outer cover 1 and inner cover 2 are lowered to the original positions (the condition shown in FIG. 1). Then, the heat of the flame is radiated from a burner (not shown) set in the burner hole 4 into the heating chamber formed between the outer cover I and inner cover 2, whereby the steel work 3 in the inner cover 2 is heated. Then, a fluorine-containing gas such as $NF_3$ is introduced into the inner cover 2 from its bottom through a pipe 9 for fluoriding. The duration of this fluoriding is generally about 30 to 60 minutes as mentioned hereinbefore.

Then, nitriding is performed as follows. Thus, since the steel work 3 after the above fluoriding treatment is covered with a fluoride film, it remains intact without surface oxidation even if it is exposed to the atmosphere such as air. The steel work in this condition is either stored or immediately subjected to nitriding in said second heating furnace for nitriding. This second heating furnace for nitriding is similar in construction with the first heating furnace described above. Thus, the inner cover 2 and outer cover 1 of this second heating furnace A' are suspended up, the steel work 3 is then stacked, and the inner cover 2 and outer cover 1 are lowered into the original positions. Then, the heat of a flame is radiated from a burner into the space between the inner cover 2 and outer cover 1 to heat the steel work in the inner cover 2 at a nitriding temperature of 480°-700° C. In this condition, $NH_3$ gas or a mixed gas composed of $NH_3$ and a carbon source-containing gas is introduced into the furnace from the bottom of the heating furnace through a pipe 9 and the steel work is maintained in this condition for about 120 minutes or more. In this process, said fluoride film is reduced or destroyed by $H_2$ or a small amount of water (by-produced in the course of nitriding reaction), for example in accordance with the following reaction, formulas, to give rise to an active steel surface.

$$CrF_4+2H_2 \rightarrow Cr+4HF$$

$$2FeF_3+3H_2 \rightarrow 2Fe+6HF$$

Referring to the above removal of the fluoride film, the film may be destroyed by introducing a mixed gas of $N_2$ and $H_2$ or $H_2$ gas prior to introduction of the nitriding gas. Rather, this practice is preferred in that the trouble due to by-production of ammonium fluoride can be avoided.

On the active steel surface thus formed, the active nitrogen derived from the nitriding gas acts to penetrate and diffuse into the steel work. As a result, towards the inside of the steel work from its surface, an ultrahard compound layer (nitride layer) containing nitrides such as CrN, $Fe_2N$, $Fe_3N$ and $Fe_4N$ is formed uniformly and to a sufficient depth, followed by formulation of a hard diffusion layer of N atoms, and the above-mentioned compound layer and diffusion layer constitute the entire nitride case.

In the case of performing both fluoriding and nitriding in a single heat treating furnace (B), a furnace of the structure illustrated in FIG. 2, for instance, is employed. In the view, 1' indicates a furnace and 2' a metal basket which is loaded with steel work (not shown). The reference numeral 3' indicates a heater, 5' an exhaust gas pipe, 6' a diabetic wall, 7' a door, 8' a fan, 10' a post, 12' a vacuum pump, and 13' a spent gas treating unit. Indicated at 21' is a furnace body having an adiabatic wall, which is internally divided into compartments 23' and 24' by a partitioning wall or shutter 22' which can be freely opened and closed. The shutter 22' is adapted to keep the two compartments 23', 24' gas-tight and insulated against heat and free to open and close by sliding vertically as shown. The reference numeral 23' indicates a fluoriding chamber, while a nitriding chamber is indicated at 24'. Each of the fluoriding chamber 23' and nitriding chamber 24' is formed with a base 25' which accepts the metal basket 2'. The base 25' consists of a pair of rails and it is so arranged that the metal basket 2' may slide on the rails selectively into the fluoriding chamber 23' or the nitriding chamber 24'. The reference numeral 26' indicates a gas inlet pipe for introduction of fluoriding gas into the fluoriding chamber 23', while a temperature sensor probe is indicated at 27'. The front opening of the fluoriding chamber 23' is releasably covered with a laterally-driven cover 7'. The reference numeral 28' indicates a nitriding gas pipe for introduction of the nitriding gas into the nitriding chamber 24'.

In the above heating furnace, nitriding is performed as follows. First, the basket 2' containing the steel work is set in the fluoriding chamber 23' and, in this condition, the internal temperature of the fluoriding chamber 23' is increased to heat the steel work to 150°-300° C. Then, in this condition, the fluorine-containing gas ($F_2+N_2$) is introduced into the chamber for fluoriding for 30 to 60 minutes. Upon completion of fluoriding, the fluoriding chamber 23' is vented to exhaust the gas.

Then, nitriding is performed as follows. The shutter 22' mentioned above is opened to transfer the steel work and the metal basket 2', as a unit, to the nitriding chamber 24' and the shutter 22' is then closed. In this condition, the internal temperature of the nitriding chamber 24' is increased to heat the steel work to 480°-600° C. and $H_2$ gas is introduced into the nitriding chamber 24' to hold the condition for 1 hour, whereby the fluoride film covering the steel surface is destroyed to expose the substrate surface of the work. Then, nitriding is conducted at that temperature for 4-5 hours introducing a nitriding gas, i.e. a mixed gas composed of $NH_3$, $N_2$, $H_2$, Co and $CO_2$ into the nitriding chamber 24'. Thereafter, the internal temperature is decreased to 350°-450° C. and, in this condition, cleaning is conducted for 1 hour by introducing a mixed gas composed of $H_2$ and $N_2$ or a mixed gas composed of $N_2$, $H_2$ and $CO_2$. Thereafter, after, the spent gas within the nitriding chamber 24 is exhausted and the shutter 22' is opened. Then, the steel work and the metal basket 2' are transferred, as a unit, to the fluoriding chamber 23' and the shutter wall 22' is closed, followed by cooling in that condition. This cooling is effected by introducing nitrogen gas from the gas inlet pipe 26' into the fluoriding chamber 23'. The thus-treated steel work has a deep and uniform nitride case. In this connection, the heating of steel work for fluoriding may be carried out in the nitriding chamber 24' by heating the same. That is, the steel work is placed directly in the nitriding chamber 24' and heated therein. Then, the shutter 22' is opened and the work is transferred to the fluoriding chamber 23' for fluoriding. The steel work is then placed in the nitriding chamber 24' again for nitriding. In this case, preheating of the nitriding chamber 24' can be effected by utilizing the heat for fluoriding of steel work.

Thus, in accordance with the present invention, the steel surface exposed upon destruction of the fluoride film has been highly activated and the nitrogen atoms act on this activated steel surface to form an ultrahard nitride layer of great depth and uniformity. Moreover, the gas used for fluoriding is a mixed gas based on $F_2$ and compared with the use of $NF_3$, it is not only inexpensive but permits the use of a lower fluoriding temperature, thus helping reduce the cost of treatment in a substantial measure.

Examples of the invention are give below.

EXAMPLES

First, an example of using a couple of heating furnaces is described.

Example 1

Fluoriding

Figure 1:
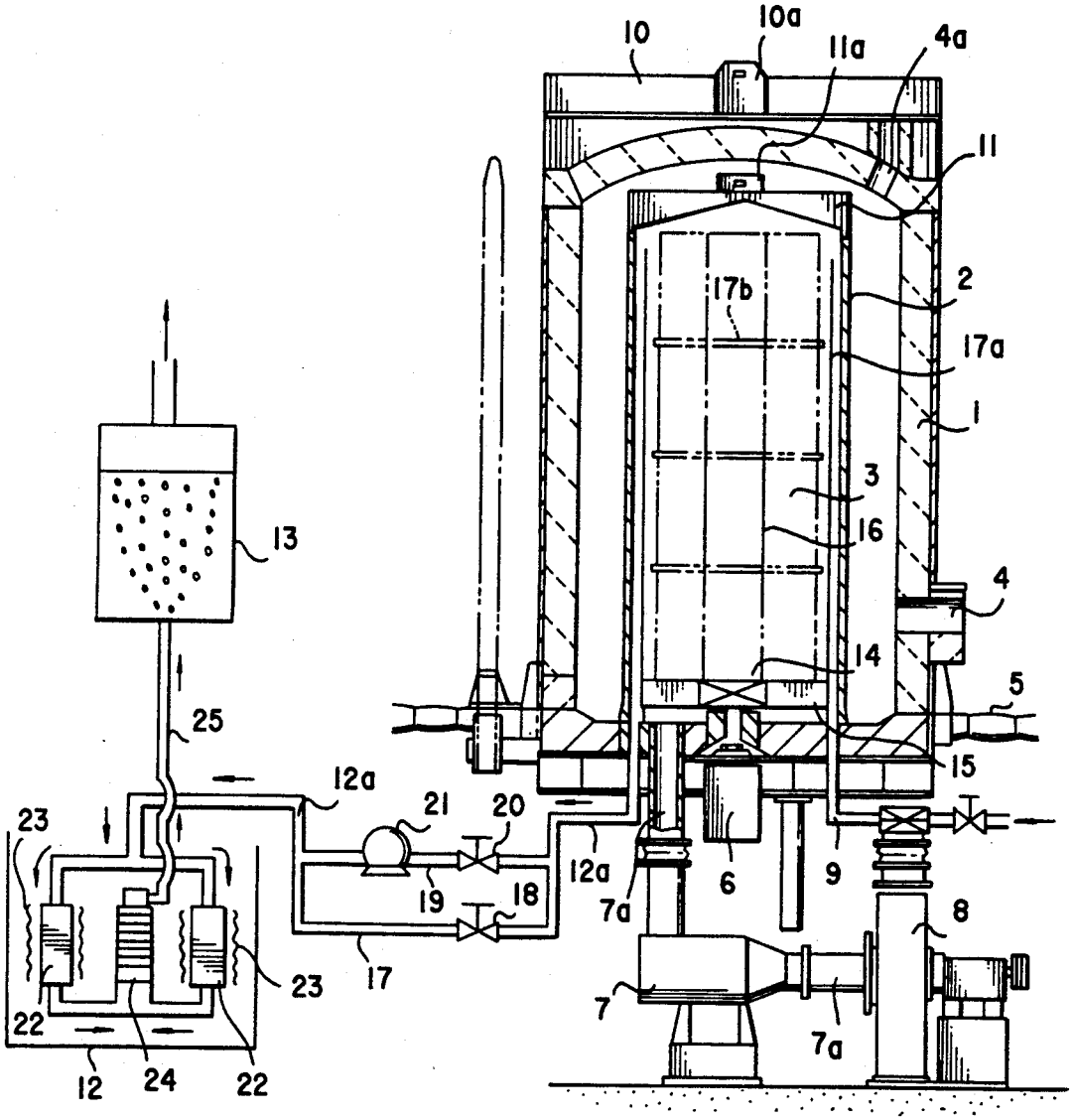
FIG. 1 is a cross-section view showing an example of the heat treating furnace used in the present invention.

A plurality of austenitic stainless steel screws (samples) were manufactured and cleaned with trichloroethylene vapor. The screws were charged into a first heating furnace (FIG. 1), in which they were sufficiently baked at 200° C. as mentioned hereinbefore. Then, in this condition, a mixed gas composed of 10% of $F_2$ and the balance of $N_2$ was introduced into the furnace at a rate equal to 5 times the internal volume of the furnace per unit time and the work was maintained for 60 minutes. Thereafter, some of the samples were taken out and the surface layer of each sample was examined. It was confirmed that a fluoride film had been formed all over the surface.

Nitriding

The samples subjected to the above fluoriding treatment were transferred to a second heating furnace A' and $NH_3$+50% RX gas was introduced into the furnace for nitriding at 530° C. for 6 hours. After completion of this treatment, the samples were air-cooled and taken out from the furnace. The above procedure provided-nitrogen case-hardened austenitic stainless steel screws.

Comparative Example 1

The procedure described in Example 1 was repeated except that the fluoriding gas was replaced with a mixed gas of $N_2$+$NF_3$ (concentration 1%) and the fluoriding temperature was replaced with 410° C. to provide nitrogen case-hardened austenitic stainless steel screws.

The hardness, condition and thickness of the nitride case of the product of Example 1 were compared with those of the product of Comparative Example 1. As a result, both products were found to be equivalent in quality. In contrast, the cost of the product of Example 1 was one-third of the cost of the product of Comparative Example 1.

Example 2

Fluoriding

A plurality of automotive engine suction valves (samples) were manufactured and placed directly in a heating furnace A to raise their temperature at 280° C. In this condition, a mixed gas composed of $N_2$+10% $F_2$+8% $NF_3$ was introduced at a rate equal to 10 times the internal volume of the furnace per unit time and the work was held for 30 minutes. Thereafter, some of the samples were taken out and the surface layer of each sample was examined. As a result, it was confirmed that a fluoride film had been formed throughout the surface.

Nitriding

The samples subjected to the above fluoriding treatment was transferred to a second heat treating furnace A' and heated to 570° C. In this condition, a nitriding gas of $NH_3$+50% RX gas was introduced for 120 minutes. Thereafter, the samples were air-cooled and taken out from the furnace.

Comparative Example 2

Fluoriding was carried out at 380° C. using a blanket gas of $NF_3$ gas (1%)+$N_2$ under otherwise the same conditions as Example 2 to provide samples of an engine valve.

The product of Example 2 was equivalent in quality to the product of Comparative Example 2. The proportion of the cost of fluoriding gas in the cost of the product engine valve in Example 2 was lower by 40% as compared with the product of Comparative Example 2 obtained using $NF_3$. Moreover, the heating and cooling time in the fluoriding step could be reduced by 75 minutes.

Some examples using a single heat treating furnace (B) are given below.

Example 3

Figure 2:
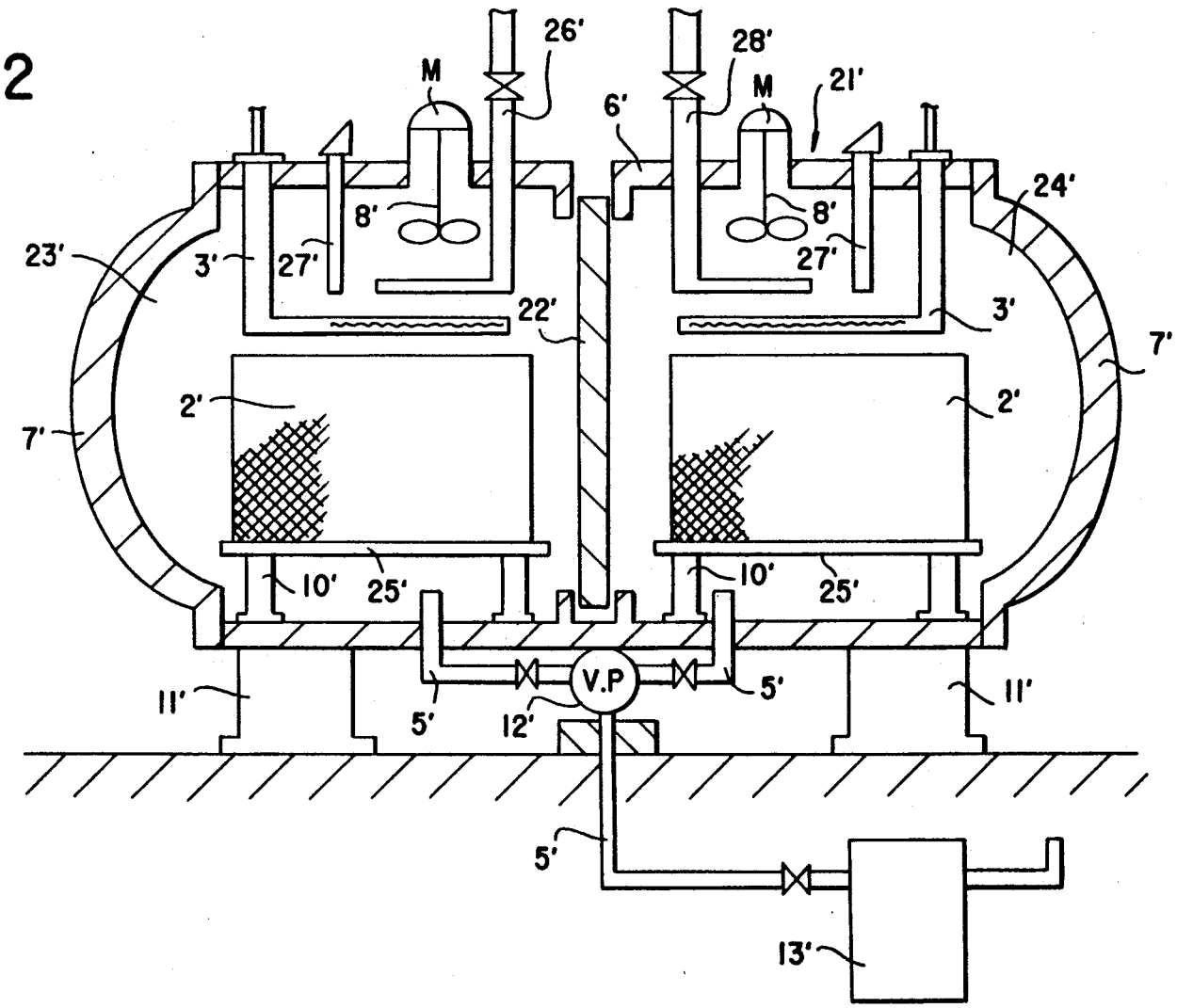
FIG. 2 is an elementary view of another heat treating furnace.

Fluoriding and nitriding were performed using a heat treating furnace having a fluoriding chamber and a nitriding chamber as shown in FIG. 2. The respective treatments were carried out as previously described in the text of this specification and the conditions in each treatment were the same as in Example 1. The same result was obtained as that of Example 1.

Example 4

Fluoriding and nitriding were performed using a heat treating furnace having a fluoriding chamber and a nitriding chamber as shown in FIG. 2. The respective treatments were carried out as previously described in the text of the specification and conditions in each -treatment were the same as in Example 2. The same result was obtained as that of Example 2.

As mentioned hereinbefore, the method of the present invention employing a mixed gas based on inexpensive fluorine gas for fluoriding permits a drastic reduction of treatment cost. Furthermore, since fluoriding can be accomplished at a temperature lower by 100°-150° C. than that of fluoriding with $NF_3$, the thermal energy requirements are reduced and this also contributes remarkably to cost reduction. Particularly because fluoriding can be accomplished at such a comparatively low temperature, the cooling time following fluoriding can also be curtailed so that the whole process can be expedited. Furthermore, because fluorine gas has an intense odor, it is more amenable to leak detection than $NF_3$ and the pollution problem associated with harmful $F_2$ can be prevented with greater assurance. Furthermore, this lower temperature for fluoriding brings forth further advantages design-wise in the case of a heat treating furnace (continuous furnace) having both a fluoriding chamber and a nitriding chamber. For example, there is the advantage that the serviceable life of the seal packing for the shutter between the nitriding chamber and the fluoriding chamber is prolonged. Thus, since the fluorine gas used for fluoriding is highly corrosive, the aging of characteristics of the seal packing is less pronounced when the temperature of the fluoriding chamber is low, so that a longer packing life can be realized. Among other advantages are the simplification and longer lives of reinforcing and other members of the structure.

What is claimed is:

1. A method for nitriding steel comprising fluoriding a steel work in heated condition in an atmosphere of a mixed gas composed of fluorine gas and inert gas and, then, nitriding the fluorided steel work in heated condition in an atmosphere of nitriding gas.

2. A method for nitriding steel comprising fluoriding a steel work in heated condition in an atmosphere of a mixed gas composed of fluorine gas trifluoride gas and inert gas and, then, nitriding the fluorided steel work in heated condition in an atmosphere of nitriding gas.

* * * * *